US005246470A

United States Patent [19]

Berg et al.

[11] Patent Number: 5,246,470

[45] Date of Patent: Sep. 21, 1993

[54] REMOVAL OF SULFUR FROM COAL AND PITCH WITH DOLOMITE

[75] Inventors: Lloyd Berg, 1314 S. 3rd Ave., Bozeman, Mont. 59715; John W. Berg; John C. Orth, both of Bozeman, Mont.

[73] Assignee: Lloyd Berg, Bozeman, Mont.

[21] Appl. No.: 984,513

[22] Filed: Dec. 2, 1992

[51] Int. Cl.[5] ..... C10L 9/08

[52] U.S. Cl. ..... 44/620; 44/622; 44/311

[58] Field of Search ..... 44/311, 620, 622

[56] References Cited

U.S. PATENT DOCUMENTS

| | | | |
|---|---|---|---|
| 1,750,609 | 3/1930 | Turke | 44/620 |
| 4,981,667 | 1/1991 | Berg et al. | 423/244 A |
| 5,125,932 | 6/1992 | Orth et al. | 44/620 |

*Primary Examiner*—Jacqueline V. Howard

[57] ABSTRACT

The sulfur in bituminous coal can be converted to calcium sulfate instead of sulfur dioxide during combustion when it is mixed with petroleum pitch and calcium oxide, calcium carbonate or dolomite.

1 Claim, No Drawings

REMOVAL OF SULFUR FROM COAL AND PITCH WITH DOLOMITE

FIELD OF THE INVENTION

This invention relates to a method or process for the dissolution of bituminous coal in petroleum pitch with sufficient lime or dolomite to combine with the sulfur in the coal and the pitch during combustion of the mixture.

DESCRIPTION OF THE PRIOR ART

Since the advent of the EPA regulation to limit the sulfur content of fuels to one pound of sulfur per million Btu, there has become considerable interest in converting high sulfur fuels into a form to enable their combustion to meet this regulation. The usual method employed is to absorb the $SO_2$ produced from the stack gases. The EPA at the Pittsburgh Energy Tech Center carried out a research program in which they mixed finely ground coal with sufficient powdered $CaCO_3$ to convert the sulfur to $CaSO_4$, a solid that would then come off mixed with the fly ash. They found that only a fraction of the $CaCO_3$ reacted with the sulfur in the coal and much of the sulfur continued to be emitted as $SO_2$. One reason for this lack of success is because their process depends on the solid coal reacting with the solid particles of the $CaCO_3$. Or gaseous $SO_2$ formed by combustion of the coal must react with the fine particles of lime sorbent. This is a gas to solid surface reaction which may be concentration or diffusion limited.

L. Berg and J. W. Berg, U.S. Pat. No. 4,981,667 showed that by adding sufficient CaO or $CaCO_3$ to react with the sulfur in the pitch, the sulfur was converted to $CaSO_4$. They further found that the admixture of pitch with fluid coke and sufficient CaO of $CaCO_3$ sorbent to react with the sum of the sulfur contents of the pitch and the coke produced a fuel which upon-combustion converted the sulfur to $CaSO_4$ in the solid combustion ash. J.C. Orth and L. Berg, U.S. Pat. No. 5,125,932 used $CaCO_3$ or CaO and petroleum pitch mixed with sub-bituminous coal to react with the sulfur in both the sub-bituminous coal and the pitch to obtain the sulfur as $CaSO_4$ in the ash.

OBJECTIVE OF THE INVENTION

The object of this invention is to provide a method or process for incorporating high sulfur bituminous coal into a carbonaceous liquid which can be pumped and/or burned in a liquid fuel burner and in which the sulfur contained therein comes off as $CaSO_4$.

SUMMARY OF THE INVENTION

The objects of this invention are provided by a process for incorporating high sulfur bituminous coal into a liquid mixture by the dissolution of powdered bituminous coal in petroleum pitch with the addition of sufficient CaO, $CaCO_3$ or dolomite ($CaCO_3$-$MgCO_3$) to convert the inorganic sulfur in the coal, the organic sulfur in the coal and the sulfur in the pitch into $CaSO_4$ when the mixture is burned in air.

DETAILED DESCRIPTION OF THE INVENTION

We have discovered that when powdered bituminous coal is mixed with hot molten petroleum pitch, the coal will uniformly disperse in the pitch producing a single liquid phase. We also found that if powdered CaO, $CaCO_3$ or dolomite ($CaCO_3$-$MgCO_3$) is added to the molten mixture, it too will completely disperse giving a single liquid phase. Thus we now have these three components intermingled at the near-molecular level. This gives a contact between the molecules of the coal, pitch and $CaCO_3$ much greater than when they are separately mixed as finely ground particles in a combustion chamber. The presence of the pitch is the reason why this mixture is effective in converting substantially all of the sulfur to $CaSO_4$ whereas as noted above, when the mixture was finely ground coal and lime particles, conversion to $CaSO_4$ was incomplete. When we burned the pitch-dissolved-mixtures, we found that the inorganic sulfur compounds in the coal, the organic sulfur compounds in the coal and the sulfur in the pitch were substantially converged into $CaSO_4$, a high melting solid (1450° C.) and remained with the ash from the coal. When sufficient CaO, $CaCO_3$ or dolomite to react with the sulfur in the coal and the pitch is added, the sulfur is converted to calcium sulfate instead of sulfur dioxide when this mixture is burned as a fuel.

USEFULNESS OF THE INVENTION

Coal does not melt regardless of how high it is heated and therefore is precluded for use as a liquid fuel. When coal is powdered and mixed with hot petroleum pitch, dispersion of the coal occurs giving a single phase material which is then suitable for use with liquid fuel burners. When sufficient powdered CaO, $CaCO_3$ or dolomite is added to the coal-pitch mixture, the sulfur in the coal and in the pitch react during burning into $CaSO_4$ instead of $SO_2$. This minimizes the need for $SO_2$ scrubbers when high sulfur bituminous coal is the fuel. The $CaSO_4$ becomes mixed with the bottom and fly ash from the coal and is disposed of with that ash or it may be recovered from the ash. As indicated above, solid calcium carbonate does not react appreciably with solid coal regardless of particle size. In U.S. Pat. No. 4,981,667 we discovered a material that is a pseudo-solvent for $CaCO_3$, namely petroleum pitch, and thus remove the sulfur in the pitch when it is used as a fuel. In U.S. Pat. 5,125,932 we discovered that petroleum pitch containing $CaCO_3$ is also a pseudo-solvent for carbon and carbonaceous material In this invention, we discovered that petroleum pitch will dissolve the coal and enough $CaCO_3$ to convert both the sulfur in the pitch and the sulfur in the coal into $CaSO_4$ to result in the conversion of both the sulfur in the coal and the sulfur in the pitch.

WORKING EXAMPLES

Example 1:

Seventy grams of 100 mesh powdered CONSOL Bailey Mine, Greene County, Pa. bituminous coal containing 2.2% water, 1.6% sulfur and 5.8% ash was mixed with 30 grams of petroleum pitch containing 5% sulfur, and nine grams of $CaCO_3$. The heat content of this mixture was 14,244 Btu/lb. and the ash content of the mixture was 12.5%. The mixture was allowed to burn in air. The resulting ash was predominantly $CaSO_4$ and contained 13.6% sulfur. This indicates that the sulfur in the coal and in the pitch is converted to $CaSO_4$, a high melting form of sulfur.

Example 2:

Seventy grams of 100 mesh powdered Island Creek Hamilton mine, Ky. bituminous coal containing 2% sulfur and 6% ash was mixed with 30 grams of petroleum pitch containing 5% sulfur, and nine grams of $CaO_3$. The ash content of the mixture was 21.6% and its heat content was 12,728 Btu/lb. This mixture was allowed to burn in air. The resulting ash was $CaSO_4$ containing 9.1% sulfur indicating that the sulfur in the coal and in the pitch was substantially converted to $CaSO_4$.

Example 3:

Seventy grams of 100 mesh powdered Monterey Carlinville, Ill. bituminous coal containing 27% water, 9.2% ash, 1.5% sulfur and 8900 Btu/lb. was mixed with thirty grams of petroleum pitch containing 5% sulfur and nine grams of CaO. The mixture had a heating value of 14,446 Btu/lb. This mixture was allowed to burn in air. The resulting ash contained 14.8% sulfur indicating that the sulfur in the coal and the pitch was converted into $CaSO_4$.

Example 4:

Twenty-one grams of 100 mesh powdered Island Creek Hamilton mine, Ky. bituminous coal containing 2% sulfur and 6% ash was mixed with fourteen grams of petroleum pitch containing 5% sulfur, 1.6 grams of $CaCO_3$ and 1.4 grams of $MgCO_3$ (dolomite). This mixture had a heat content of 12,500 Btu/lb. It was allowed to burn with ample air. The resulting ash contained 18% sulfur. This indicates that the inorganic sulfur in the coal, the organic sulfur in the coal and the sulfur in the pitch was substantially converted to $CaSO_4$.

We claim:

1. A method for making a meltable uniform carbonaceous mixture from coal, petroleum pitch and dolomite which comprises mixing the coal particles in the range of 100–200 mesh size with petroleum pitch and sufficient dolomite to convert the sulfur content of the pitch and the coal to calcium sulfate during burning, and heating said mixture at 300–500° F. for ten to thirty minutes.

* * * * *